US011127391B2

(12) United States Patent
Wang et al.

(10) Patent No.: US 11,127,391 B2
(45) Date of Patent: Sep. 21, 2021

(54) ACTIVE VIBRATORY NOISE REDUCTION SYSTEM

(71) Applicant: HONDA MOTOR CO., LTD., Tokyo (JP)

(72) Inventors: Xun Wang, Saitama (JP); Toshio Inoue, Saitama (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 17/151,843

(22) Filed: Jan. 19, 2021

(65) Prior Publication Data

US 2021/0225353 A1 Jul. 22, 2021

(30) Foreign Application Priority Data

Jan. 21, 2020 (JP) ..... JP2020-007520

(51) Int. Cl.
*G10K 11/178* (2006.01)

(52) U.S. Cl.
CPC .. *G10K 11/17854* (2018.01); *G10K 11/17883* (2018.01); *G10K 2210/121* (2013.01); *G10K 2210/1282* (2013.01); *G10K 2210/3026* (2013.01); *G10K 2210/3027* (2013.01); *G10K 2210/3028* (2013.01); *G10K 2210/503* (2013.01)

(58) Field of Classification Search
CPC ..... G10K 2210/503
See application file for complete search history.

(56) References Cited

U.S. PATENT DOCUMENTS

2004/0240678 A1 12/2004 Nakamura et al.
2008/0292110 A1 11/2008 Kobayashi et al.

FOREIGN PATENT DOCUMENTS

JP 2000099037 A 4/2000
JP 2004354657 A 12/2004
JP 2008239098 A 10/2008

*Primary Examiner* — Ping Lee
(74) *Attorney, Agent, or Firm* — Armstrong Teasdale LLP

(57) ABSTRACT

An active vibratory noise reduction system includes: a canceling vibratory sound generator; an error signal detector for detecting a canceling error between the canceling vibratory sound and a vibratory noise as an error signal; and an active vibratory noise controller for generating, based on the error signal, a control signal for controlling the canceling vibratory sound generator. The active vibratory noise controller is provided with a stability improving unit including: a correction value generation unit for generating an error signal correction value by multiplying a reaching control sound estimation value by a stabilization coefficient; an error signal correction unit for correcting the error signal by using the error signal correction value to generate a corrected error signal, and a stabilization coefficient updating unit for sequentially updating the stabilization coefficient based on the corrected error signal and the reaching control sound estimation value by using an adaptive algorithm.

6 Claims, 20 Drawing Sheets

ACTIVE VIBRATORY NOISE REDUCTION SYSTEM

TECHNICAL FIELD

The present disclosure relates to an active vibratory noise reduction system for generating, by using an adaptive notch filter, control sound that is in opposite phase with the vibratory noise, such as in-compartment noise, generated from engine rotation, vehicle travel, etc. and making the control sound interfere with the vibratory noise to reduce the vibratory noise.

BACKGROUND ART

An active vibratory noise reduction system that uses an adaptive notch filter (Single-frequency Adaptive Notch filter (SAN filter)) to adaptively control unpleasant periodic noise (engine muffling sound) produced in the passenger compartment due to engine rotation has been proposed (see JP2000-99037A). The adaptive notch filter requires a relatively small amount of calculation. Besides the engine muffling sound, in-compartment periodic noise may be produced by a rotating body such as a propeller shaft when the vehicle travels, and an active vibratory noise reduction system that uses an adaptive filter (adaptive notch filter) to reduce such in-compartment periodic noise has been also proposed (see JP2008-239098A).

These active vibratory noise reduction systems generally have a configuration as shown in FIG. 19. In this system, first, the frequency f of the periodic noise is estimated based on vehicle information such as an engine rotational speed and a vehicle speed, and a cosine wave signal rc and a sine wave signal rs are generated as reference signals. Then, a control signal u is generated by processing these reference signals by an adaptive notch filter having a first filter coefficient W0 for the cosine wave signal rc and a second filter coefficient W1 for the sine wave signal rs, and canceling sound generated based on the control signal u is output from a control loudspeaker. A microphone (error microphone) for detecting the noise (noise after the canceling) is installed at a control target position of the noise reduction, and a filter coefficient updating unit performs update (adaptive control) of the filter coefficients of the adaptive notch filter by using an adaptive algorithm such as the LMS (Least Mean Square) algorithm such that the sound pressure at the error microphone (error signal e) is minimized. The adaptive update needs to be performed on only the two variables (W0, W1), and thus, this technique is characterized by a low computational load and a high adaptation speed.

However, since acoustic characteristics C, which include electronic circuit characteristics, exist between the control loudspeaker and the error microphone, the update of the filter coefficients of the adaptive notch filter needs to take into account the acoustic characteristics C. Therefore, in these active vibratory noise reduction systems, the acoustic characteristics C are measured (identified) beforehand as transfer characteristics Cˆ, which include amplitude characteristics and frequency characteristics and are expressed by a transfer function having a real part Cˆ0 and an imaginary part Cˆ1 that are a function of frequency, and the reference signals are corrected by a filtering process (filtering) based on the identified transfer characteristics Cˆ so that the corrected reference signals are used in the coefficient update of the adaptive notch filter. Specifically, the reference signals are corrected by a reference signal correction unit constituted of corrective filters having filter coefficients set in accordance with the transfer characteristics Cˆ (the real part Cˆ0 and the imaginary part Cˆ1). The control system of this type is referred to as a Filtered-X type. Note that "ˆ" (hat symbol) means the identified or estimated value of the indicated quantity and is placed above the symbol representing the quantity in the drawings and the formulas (or statements) but is placed after the symbol in the description.

As described above, in the Filtered-X type control system, the corrective filters constituting the reference signal correction unit are fixed filters in a sense that the filter coefficients thereof are set based on the transfer characteristics Cˆ identified beforehand. On the other hand, the actual acoustic characteristics C can change depending on the vehicle state such as aging of the loudspeaker and the microphone, the opening/closing state of the windows and the doors, the seat positions, the number of vehicle occupants, and so on. If the acoustic characteristics C change, a difference is created between the acoustic characteristics C and the transfer characteristics Cˆ identified beforehand, and due to this difference, the updating process of the adaptive notch filter may diverge so that the noise may be amplified and/or abnormal sound may be generated.

To address such a problem, the applicant of the present application has proposed an active vibratory noise reduction system adopting a technique in which a coefficient for stabilization (hereinafter referred to as a stabilization coefficient α) is introduced to suppress the amplitude of the control output thereby to improve the stability of the control system (see JP2004-354657A). This active vibratory noise reduction system has a structure essentially shown in FIG. 20 and operates based on the following principle.

$$e'=e+\alpha*u*\hat{C}$$

$$e=d+y,\ \hat{y}=u*\hat{C},\ y\approx\hat{y}$$

therefore, $$e'=d+(1+\alpha)y$$

where e' represents the corrected error signal, e represents the error signal, a represents the stabilization coefficient, u represents the control signal, Cˆ represents the transfer characteristics identified beforehand, d represents the noise input to the error microphone, y represents the reaching control sound (control sound that reaches the error microphone), and yˆ represents the estimated value of the reaching control sound.

In this control system, the filter coefficients W of the adaptive notch filter are updated such that the apparent (virtual) corrected error signal e' which is obtained by correcting the error signal e by using the stabilization coefficient α is minimized (becomes zero), and the reaching control sound y required in this case is 1/(1+α) of the reaching control sound y required to minimize the original (uncorrected) error signal e. Therefore, by setting the stabilization coefficient α to a value greater than or equal to 0 (zero), excessive control sound output is suppressed and the system stability is improved. On the other hand, the reduction in the reaching control sound y results in the reduction in the noise canceling performance at the control target position (installation position of the error microphone). Therefore, in a state where the acoustic characteristics C match the filter coefficients Cˆ, such as when the doors and the windows are all closed, it is preferred to make the stabilization coefficient α have a small value so that the noise canceling performance is prioritized.

The stabilization coefficient α in the conventional stability improvement technology is a parameter having a fixed value and is set beforehand in accordance with an assumed worst condition (a condition in which the change of the acoustic characteristics C is the largest) so that abnormal sound will not be generated during the control of the active noise reduction system. However, such a setting may cause the following problems. First, the setting of the stabilization coefficient α has a trade-off between the control stability and the noise canceling performance, and if the stabilization coefficient α is set to a large value to secure the control stability even though the assumed worst condition rarely occurs, the noise canceling performance is unduly compromised. Second, if a change of the acoustic characteristics C exceeding the assumed worst condition occurs, the control stability cannot be ensured, and the noise amplification and/or the abnormal sound generation cannot be avoided.

SUMMARY OF THE INVENTION

In view of such background, an object of the present invention is to provide an active vibratory noise reduction system capable of achieving both reliable control stability and excellent noise canceling performance even when a change of the acoustic characteristics C occurs.

To achieve such an object, one embodiment of the present invention provides an active vibratory noise reduction system (10), comprising: a canceling vibratory sound generator (12, 14) configured to generate canceling vibratory sound for canceling vibratory noise generated from a vibratory noise source (2); an error signal detector (11, 15) configured to detect a canceling error between the vibratory noise and the canceling vibratory sound as an error signal (e); and an active vibratory noise controller (13) configured to receive the error signal and to supply a control signal (u) for causing the canceling vibratory sound generator to generate the canceling vibratory sound, wherein the active vibratory noise controller comprises: a reference signal generation unit (21) configured to generate a reference signal (r (rc, rs)) that is synchronous with a vibration frequency of the vibratory noise source; a reference signal correction unit (25) configured to correct the reference signal with simulated transfer characteristics (CA) to generate a corrected reference signal (r' (rc', rs')), the simulated transfer characteristics representing acoustic characteristics (C) from the canceling vibratory sound generator to the error signal detector that are identified beforehand; an adaptive notch filter (26) configured to generate the control signal (u) based on the reference signal; a filter coefficient updating unit (27) configured to sequentially update filter coefficients (W (W0, W1)) of the adaptive notch filter by using an adaptive algorithm; and a stability improving unit (50) configured to correct the error signal (e), wherein the stability improving unit comprises: a correction value generation unit (51) configured to generate, based on the corrected reference signal, a reaching control sound estimation value (y^), which is an estimated value of the canceling vibratory sound that reaches the error signal detector, and to multiply the reaching control sound estimation value by a stabilization coefficient (a) to generate an error signal correction value (αy^); and an error signal correction unit (46) configured to correct the error signal by using the error signal correction value to generate a corrected error signal (e'), wherein the filter coefficient updating unit (27) sequentially updates the filter coefficients (W (W0, W1)) based on the corrected reference signal (rc', rs') and the corrected error signal (e'), and wherein the stability improving unit (50) further comprises a stabilization coefficient updating unit (56) configured to sequentially update the stabilization coefficient (a) based on the corrected error signal (e') and the reaching control sound estimation value (y^) by using an adaptive algorithm.

According to this configuration, the stabilization coefficient updating unit can adaptively adjust the stabilization coefficient during the control so as to increase the stabilization coefficient only when necessary, and therefore, it is possible to achieve both reliable control stability and excellent noise canceling performance.

In the above configuration, preferably, the stability improving unit (50) further comprises: a correction value adjustment unit (61) having multiple modes with varying degrees of adjustment of the stabilization coefficient (α), the correction value adjustment unit being configured to obtain an adjusted stabilization coefficient (α') by adjusting the stabilization coefficient in accordance with the degree of adjustment of one of the multiple modes selected based on the stabilization coefficient and to generate an adjusted correction value (α'y^) by multiplying the reaching control sound estimation value (y^) by the adjusted stabilization coefficient; and an error signal adjustment unit (64) configured to generate an adjusted error signal (e") by correcting the error signal (e) by using the adjusted correction value generated by the correction value adjustment unit, wherein the filter coefficient updating unit (27) sequentially updates the filter coefficients (W (W0, W1)) based on the corrected reference signal (rc', rs') and the adjusted error signal (e").

According to this configuration, besides the adaptive processing of the stabilization coefficient, the adjusted stabilization coefficient used in the update of the filter coefficients of the adaptive notch filter can be set in steps in accordance with the mode.

In the above configuration, preferably, the multiple modes includes a control output limiting mode which is selected when the stabilization coefficient (α) is smaller than a prescribed minimum value ($\alpha_{min}$) and in which the minimum value is set as the adjusted stabilization coefficient (α'), a stability securing mode which is selected when the stabilization coefficient is greater than a prescribed threshold value ($\alpha_{th}$) greater than the minimum value and in which a prescribed maximum value ($\alpha_{max}$) greater than the threshold value is set as the adjusted stabilization coefficient, and an adaptive mode which is selected when the stabilization coefficient is greater than or equal to the minimum value and smaller than or equal to the threshold value and in which the stabilization coefficient is set as the adjusted stabilization coefficient.

According to this configuration, the adjusted stabilization coefficient used in the update of the filter coefficients of the adaptive notch filter is set in steps in accordance with the mode selected depending on the value of the stabilization coefficient, whereby the stability can be improved even further while the noise canceling effect near an ear of a vehicle occupant can be ensured.

In the above configuration, preferably, the correction value adjustment unit (61) is configured to set the minimum value ($\alpha_{min}$) depending on the vibration frequency of the vibratory noise source.

According to this configuration, a difference between the sound pressure at the error signal detector and the actual sound pressure near an ear of a vehicle occupant can be reduced in accordance with the vibration frequency of the vibratory noise source.

In the above configuration, preferably, when the stabilization coefficient (α) exceeds the maximum value ($\alpha_{max}$), the correction value adjustment unit (61) holds the adjusted stabilization coefficient ($\alpha'$) at the maximum value for a prescribed time period (t).

According to this configuration, it is possible to prevent hearing discomfort that may be caused when the stability securing mode in which the control tends to be unstable and the adaptive mode in which the control is stable are switched repeatedly in a short period of time.

Thus, according to the present invention, it is possible to provide an active vibratory noise reduction system capable of achieving both reliable control stability and excellent noise canceling performance even when a change of the acoustic characteristics C occurs.

DESCRIPTION OF THE PREFERRED EMBODIMENT(S)

In the following, embodiments of the present invention will be described in detail with reference to the appended drawings.

Figure 1:
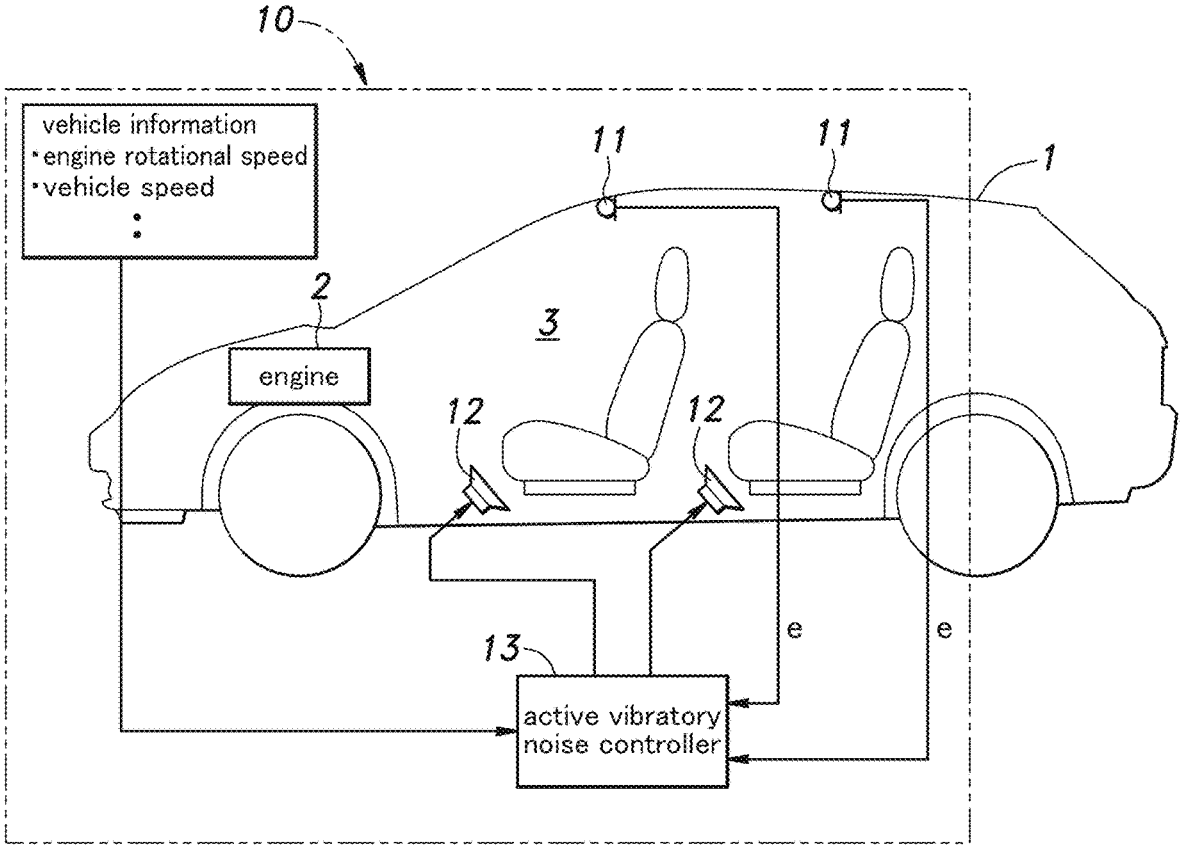
FIG. 1 is a configuration diagram showing a first application example of an active vibratory noise reduction system according to the present invention.
Figure 2:
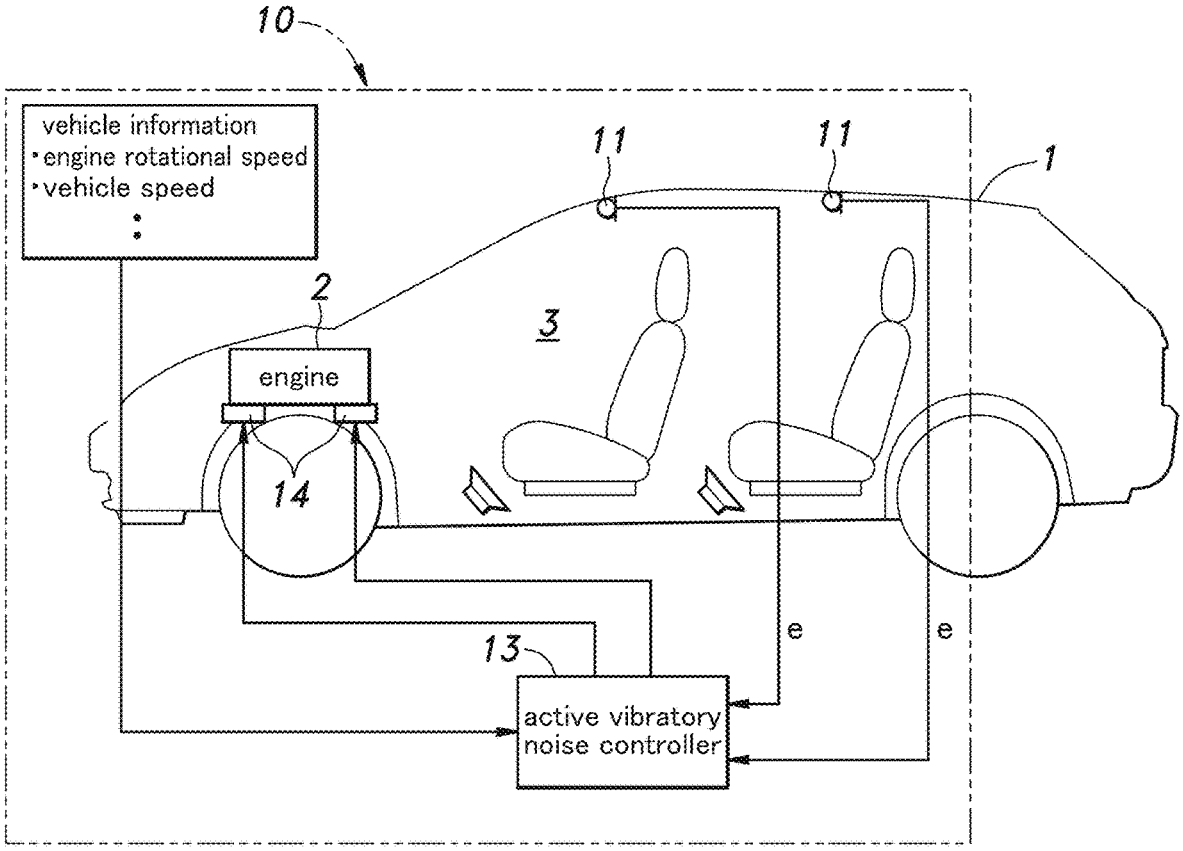
FIG. 2 is a configuration diagram showing a second application example of the active vibratory noise reduction system according to the present invention.
Figure 3:
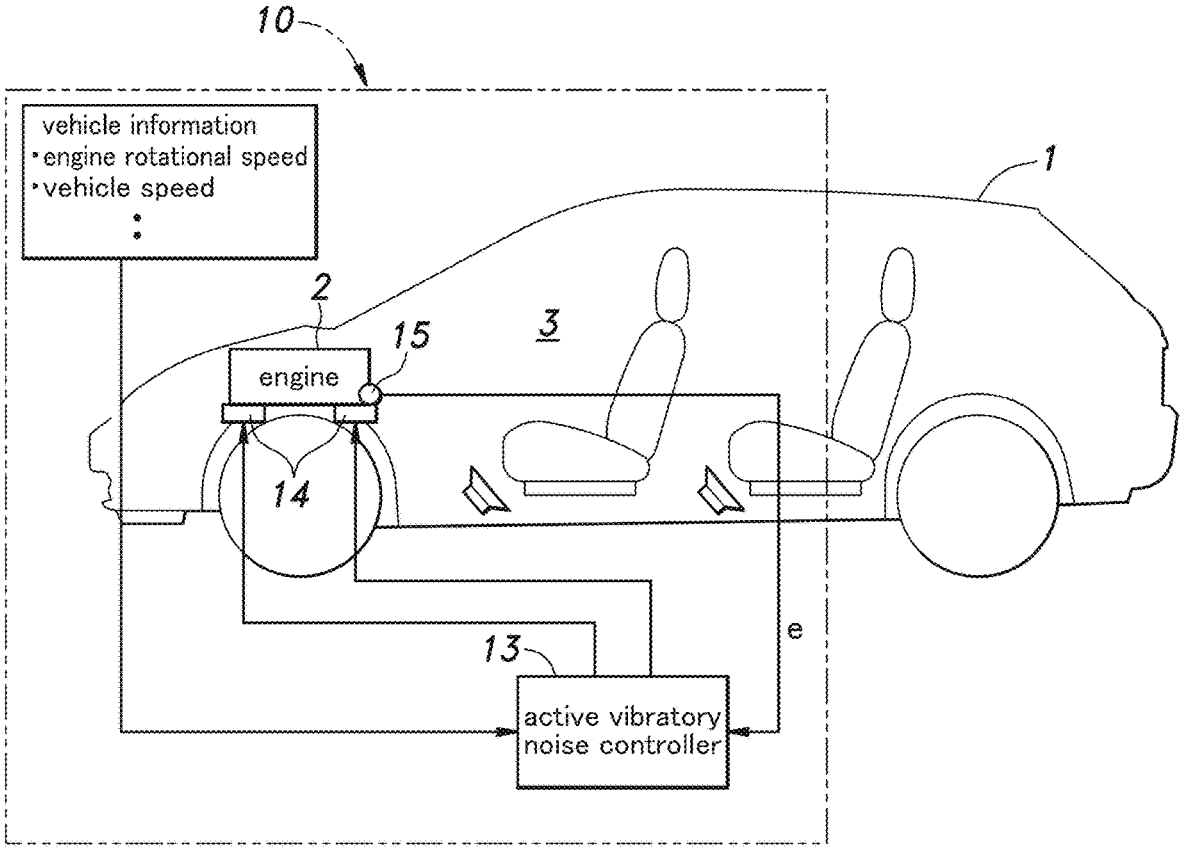
FIG. 3 is a configuration diagram showing a third the application example of the active vibratory noise reduction system according to the present invention.

FIGS. 1 to 3 are configuration diagram showing first to third application examples of an active vibratory noise reduction system 10 according to the present invention. In these examples, the active vibratory noise reduction system 10 is applied to a vehicle 1.

As shown in FIG. 1, the vehicle 1 has an engine 2 mounted thereon as a travel drive source. The active vibratory noise reduction system 10 includes error microphones 11 that serve as a vibratory noise detection unit configured to detect the noise in a passenger compartment 3, loudspeakers 12 that serve as a canceling vibratory sound generator configured to generate, as control sound for canceling the noise, canceling sound (canceling vibratory sound) that is in opposite phase with the noise, and an active vibratory noise controller 13. The error microphones 11 are placed on the ceiling above the front seats and above the rear seats, for example. The loudspeakers 12 may be the loudspeakers of an audio system such as door loudspeakers mounted in the front doors and the rear doors. Each error microphone 11 functions as an error signal detector configured to detect, as an error signal e, the canceling error between the noise from the engine 2, which is a vibratory noise source, and the canceling sound from the loudspeakers 12. The active vibratory noise controller 13 is supplied with vehicle information, such as an engine rotational speed and a vehicle speed, and the error signal e detected by each error microphone 11. The active vibratory noise controller 13 generates a control signal u for driving each loudspeaker 12 based on the vehicle information and the error signal e to control the canceling sound generated by the loudspeaker 12 so that the engine noise (engine muffling sound) transmitted to a vehicle occupant due to vibration of the engine 2 is reduced. In this case, the active vibratory noise controller 13 functions as an active noise controller.

The active vibratory noise reduction system 10 shown in FIG. 2 includes error microphones 11 for detecting the noise in the passenger compartment 3, a vibration actuator 14 that serves as a canceling vibratory sound generator configured to generate canceling vibration (canceling vibratory sound) for canceling the vibration of the engine 2 which causes noise, and an active vibratory noise controller 13. The canceling vibration generated by the vibration actuator 14 is in opposite phase with the vibration of the engine 2. The error microphones 11 are similar to those of the active vibratory noise reduction system 10 shown in FIG. 1. The vibration actuator 14 is configured such that the generated canceling vibration is applied to the engine 2, and is constituted of an active engine mount, for example. The active vibratory noise controller 13 is supplied with the vehicle information, such as the engine rotational speed and the vehicle speed, and the error signal e detected by the error microphone 11. The active vibratory noise controller 13 generates the control signal u for driving the vibration actuator 14 based on the vehicle information and the error signal e to control the canceling vibration generated by the vibration actuator 14 so that the vibration of the engine 2 is reduced and the engine noise (engine muffling sound) transmitted to the vehicle occupant due to the vibration of the engine 2 is reduced. In this case, the active vibratory noise controller 13 functions as an active vibration controller.

The active vibratory noise reduction system 10 shown in FIG. 3 includes a vibration sensor 15 that serves as a vibratory noise detection unit configured to detect the vibration of the engine 2 which causes noise in the passenger compartment 3, a vibration actuator 14 configured to generate the canceling vibration to cancel the vibration of the engine 2, and an active vibratory noise controller 13. The vibration sensor 15 is mounted on the engine 2 and functions as an error signal detector configured to detect, as an error signal e, an error vibration which is a synthesis of the engine vibration generated by the rotation of the engine 2 and the canceling vibration applied to the engine 2 by the vibration actuator 14. The vibration actuator 14 may be similar to that of the active vibratory noise reduction system 10 shown in FIG. 2. The active vibratory noise controller 13 is supplied with the vehicle information, such as the engine rotational speed and the vehicle speed, and the error signal e detected by the vibration sensor 15. The active vibratory noise controller 13 generates the control signal u for driving the vibration actuator 14 based on the vehicle information and the error signal e to control the canceling vibration generate by the vibration actuator 14 so that the engine vibration is reduced and the engine noise (engine muffling sound) transmitted to the vehicle occupant due to the vibration of the engine 2 is reduced. In this case also, the active vibratory noise controller 13 functions as an active vibration controller.

As described above, the active vibratory noise reduction system 10 according to the present invention can be used in various modes. Other than the above examples, for example, an electric motor may be mounted instead of the engine 2 as a drive source, and the active vibratory noise reduction system 10 may be configured to reduce the vibratory noise generated from the electric motor. In yet another example, the active vibratory noise reduction system 10 may be configured to reduce drive system noise transmitted to the vehicle occupant due to the vibratory noise generated from drive system rotating bodies, such as a propeller shaft and a drive shaft, during travel of the vehicle 1. Thus, the active vibratory noise reduction system 10 can reduce the vibratory noise of the engine 2 or the drive system, which generates periodic vibratory noise due to rotational motion.

In each embodiment described in the following, the vehicle 1 is provided with the engine 2 as a drive source, the active vibratory noise reduction system 10 is provided with the error microphone 11 as a vibratory noise detection unit and the loudspeaker 12 as a canceling vibratory sound generator, and the active vibratory noise controller 13 functions as an active noise controller.

First Embodiment

Figure 4:
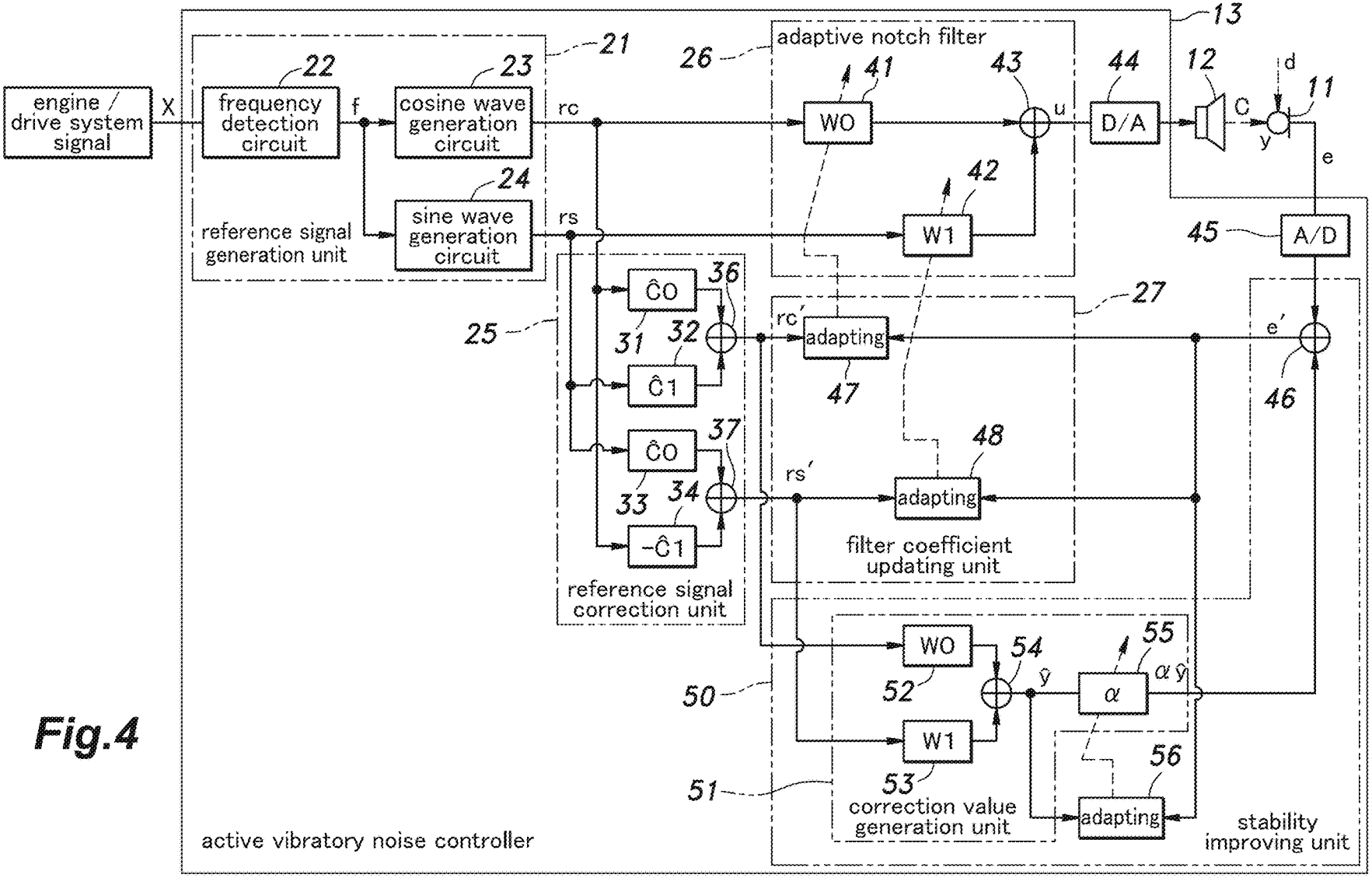
FIG. 4 is a functional block diagram of the active vibratory noise reduction system according to the first embodiment.

With reference to FIGS. 4 to 12, a first embodiment of the present invention will be described. FIG. 4 is a functional block diagram of the active vibratory noise reduction system 10 according to the first embodiment. As shown in FIG. 4, the active vibratory noise controller 13 is supplied with an engine/drive system signal X. The engine/drive system signal X may be engine pulses that are synchronous with the vibration frequency, such as the rotation frequency of the output shaft of the engine 2. The active vibratory noise controller 13 includes a reference signal generation unit 21 configured to generate reference signals r (rc, rs) based on the engine/drive system signal X. In the reference signal generation unit 21, a frequency detection circuit 22 detects, from the engine/drive system signal X, the vibration frequency of the vibratory noise source; namely, the frequency f of the vibratory noise that causes noise in the passenger compartment 3. The detected frequency f is supplied to a cosine wave generation circuit 23 and a sine wave generation circuit 24. The cosine wave generation circuit 23 generates cosine wave signal rc which serves as a reference signal r based on the supplied frequency f. The sine wave generation circuit 24 generates a sine wave signal rs which serves as a reference signal r based on the supplied frequency f. The reference signals r (rc, rs) generated by the reference signal generation unit 21 are supplied to a reference signal correction unit 25 and an adaptive notch filter 26.

In the reference signal correction unit 25, simulated transfer characteristics Cˆ that simulate the acoustic characteristics C from the loudspeaker 12 to the error microphone 11 are pre-set, where the acoustic characteristics are identified beforehand. The simulated transfer characteristics Cˆ can be expressed by a transfer function having a real part Cˆ0 and an imaginary part Cˆ1 defining amplitude characteristics and phase characteristics over a prescribed frequency range. The simulated transfer characteristics Cˆ can be represented by a single complex number for a given single frequency.

The cosine wave signal rc is input to a first filter 31 having the real part Cˆ0 of the simulated transfer characteristics Cˆ as a coefficient thereof. The sine wave signal rs is input to a second filter 32 having the imaginary part Cˆ1 of the simulated transfer characteristics Cˆ as a coefficient thereof. Also, the sine wave signal rs is input to a third filter 33 having the real part Cˆ0 of the simulated transfer characteristics Cˆ as a coefficient thereof. The cosine wave signal rc is also input to a fourth filter 34 having a value obtained by reversing the sign of the imaginary part Cˆ1 of the simulated transfer characteristics Cˆ as a coefficient thereof.

An output of the first filter 31 and an output of the second filter 32 are added together at a first adder 36 to generate a corrected cosine wave signal rc, which is supplied to a filter coefficient updating unit 27. An output of the third filter 33 and an output of the fourth filter 34 are added together at a second adder 37 to generate a corrected sine wave signal rs', which is supplied to the filter coefficient updating unit 27.

The adaptive notch filter 26 is a so-called single-frequency adaptive notch filter (SAN filter). In the adaptive notch filter 26, the cosine wave signal rc is supplied to a first adaptive filter 41 having a first filter coefficient W0, while the sine wave signal rs is supplied to a second adaptive filter 42 having a second filter coefficient W1. The first adaptive filter 41 and the second adaptive filter 42 are each a control filter in which the corresponding filter coefficient W (W0, W1) is adaptively set, and outputs a signal that is in opposite phase with the input signal. Details of the filter coefficients W (W0, W1) will be described later.

The cosine wave signal rc filtered by the first adaptive filter 41 of the adaptive notch filter 26 and the sine wave signal rs filtered by the second adaptive filter 42 of the adaptive notch filter 26 are added together at a third adder 43 to make a control signal u. Namely, the adaptive notch filter 26 serves as a control signal generation unit configured to generate the control signal u based on the reference signals r (rc, rs). The control signal u is convert to an analogue signal at a D/A converter 44 and is supplied to the loudspeaker 12. Based on the supplied control signal u, the loudspeaker 12 generates control sound for canceling the noise generated by the engine 2/the drive system, which are noise sources.

The error microphone 11 detects noise as an error signal e, where the noise is an canceling error obtained as a result of synthesis of the noise in the passenger compartment 3 (namely, periodic noise d which is generated mainly from the engine 2/the drive system and has a prescribed frequency) and reaching control sound y which is generate by the loudspeaker 12 and reaches the error microphone 11. Note that the noise detected by the error microphone 11 may include, in addition to the aforementioned canceling error noise, noise originating from parts other than the engine 2 and the drive system. The error signal e is converted to a digital signal at an A/D converter 45, and then is corrected at a fourth adder 46 to make an apparent (virtual) corrected error signal e', which is supplied to the filter coefficient updating unit 27. The fourth adder 46 is a part of a later-described stability improving unit 50, and details of the correction performed by the fourth adder 46 will be described later.

The filter coefficient updating unit 27 includes a first filter coefficient updating unit 47 configured to adaptively update the first filter coefficient W0 of the first adaptive filter 41 of the adaptive notch filter 26 and a second filter coefficient updating unit 48 configured to adaptively update the second filter coefficient W1 of the second adaptive filter 42 of the adaptive notch filter 26. The first filter coefficient updating unit 47 calculates the first filter coefficient W0 of the first adaptive filter 41 by using the LMS algorithm based on the corrected cosine wave signal rc' supplied from the reference signal correction unit 25 and the corrected error signal e' supplied from the fourth adder 46 such that the corrected error signal e' is minimized. The first filter coefficient updating unit 47 performs the coefficient calculation of the first adaptive filter 41 at each sampling time and updates the first filter coefficient W0 of the first adaptive filter 41 with the calculated value. The second filter coefficient updating unit 48 calculates the second filter coefficient W1 of the second adaptive filter 42 by using the LMS algorithm based on the corrected sine wave signal rs' supplied from the reference signal correction unit 25 and the corrected error signal e' supplied from the fourth adder 46 such that the corrected error signal e' is minimized. The second filter coefficient updating unit 48 performs the coefficient calculation of the second adaptive filter 42 at each sampling time and updates the second filter coefficient W1 of the second adaptive filter 42 with the calculated value.

In this way, in the active vibratory noise controller 13, the reference signal correction unit 25 corrects the reference signals r (the cosine wave signal rc and the sine wave signal rs) with the simulated transfer characteristics $\hat{C}$ to generate the corrected reference signals r' (the corrected cosine wave signal rc' and the corrected sine wave signal rs'). The first filter coefficient updating unit 47 and the second filter coefficient updating unit 48 of the filter coefficient updating unit 27 sequentially update the filter coefficients W (W0, W1) of the first adaptive filter 41 and the second adaptive filter 42 of the adaptive notch filter 26, respectively, based on the corresponding corrected reference signals r' (the corrected cosine wave signal rc' and the corrected sine wave signal rs') and the corrected error signal e' by using an adaptive algorithm.

Thereby, the filtering of the cosine wave signal rc and the sine wave signal rs by the first adaptive filter 41 and the second adaptive filter 42 of the adaptive notch filter 26 is optimized, and the periodic noise d from the engine 2/the drive system is canceled by the control sound generated by the loudspeaker 12 based on the control signal u so that the in-compartment noise is reduced.

The active vibratory noise controller 13 is further provided with a stability improving unit 50 for stabilizing the noise reduction performance by the control sound from the loudspeaker 12. The stability improving unit 50 is supplied with the corrected cosine wave signal rc' and the corrected sine wave signal rs' from the reference signal correction unit 25 and the corrected error signal e' from the fourth adder 46.

In the stability improving unit 50, the corrected cosine wave signal rc' is supplied to a first filter 52 of a correction value generation unit 51, while the corrected sine wave signal rs' is supplied to a second filter 53 of the correction value generation unit 51. The first filter 52 of the stability improving unit 50 has a filter coefficient same as the first filter coefficient W0 of the first adaptive filter 41 of the adaptive notch filter 26, which is adaptively updated as described above. The second filter 53 of the stability improving unit 50 has a filter coefficient same as the second filter coefficient W1 of the second adaptive filter 42 of the adaptive notch filter 26, which is adaptively updated as described above.

The corrected cosine wave signal rc' filtered by the first filter 52 of the correction value generation unit 51 and the corrected sine wave signal rs' filtered by the second filter 53 of the correction value generation unit 51 are added together at a fifth adder 54 of the correction value generation unit 51 to make a reaching control sound estimation value $\hat{y}$, which is supplied to a corrective filter 55 of the correction value generation unit 51. The reaching control sound estimation value $\hat{y}$ is an estimated value of the reaching control sound y which is the canceling sound reaching the error microphone 11 and is in opposite phase with the periodic noise d. The corrective filter 55 has an adaptive stabilization coefficient $\alpha$ and multiplies the reaching control sound estimation value $\hat{y}$ by the adaptive stabilization coefficient $\alpha$ to generate an error signal correction value $\alpha\hat{y}$, which is a correction value for the error signal e. The generated error signal correction value $\alpha\hat{y}$ is supplied to the fourth adder 46 and is added to the error signal e to correct the same; namely, the fourth adder 46 functions as an error signal correction unit configured to correct the error signal e by using the error signal correction value $\alpha\hat{y}$ and thereby to generate the corrected error signal e'. In this way, the apparent corrected error signal e' is output from the fourth adder 46.

In addition to being supplied to the filter coefficient updating unit 27 as described above, the corrected error signal e' output from the fourth adder 46 is also supplied to the stability improving unit 50. The stability improving unit 50 is provided with a stabilization coefficient updating unit 56 configured to adaptively update the stabilization coefficient $\alpha$ of the corrective filter 55. The stabilization coefficient updating unit 56 adaptively updates the stabilization coefficient $\alpha$ of the corrective filter 55 based on the reaching control sound estimation value $\hat{y}$ supplied from the fifth adder 54 and the apparent corrected error signal e' supplied from the fourth adder 46 such that the corrected error signal e' is minimized. In the following, description will be made concretely.

Provided that the sampling time is represented by "n," the stabilization coefficient updating unit 56 performs the update by using the following evaluation function J regarding the corrected error signal e'. Specifically, the stabilization coefficient updating unit 56 adaptively adjusts the stabilization coefficient $\alpha$ by using the LMS algorithm such that the evaluation function Jn represented by the following formula is minimized (becomes zero).

$$J_n=e_n'^2=(e_n+\alpha_n\hat{y}_n)^2,\ \hat{y}_n=r_n*\hat{C}*W_n$$

where J represents the evaluation function, n represents the sampling time, e' represents the corrected error signal, e represents the error signal, a represents the stabilization coefficient, y^ represents the reaching control sound estimation value, r represents the reference signal, C^ represents the simulated transfer characteristics, W represents the filter coefficient, and * represent the filtering operation.

Figure 5:
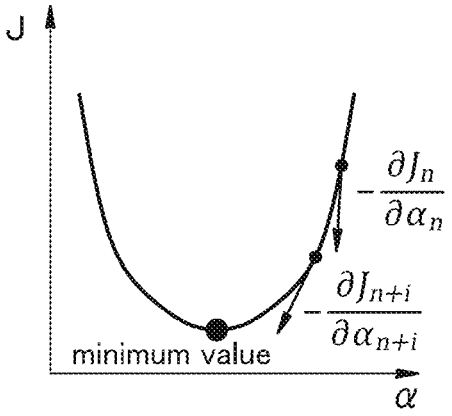
FIG. 5 is an explanatory diagram of an adaptive process according to the LMS algorithm.

This can be illustrated by an operating point on the error surface as shown in FIG. 5. The stabilization coefficient α is updated in a negative direction of a gradient of a tangential line of the evaluation function J, and the amount of update of the stabilization coefficient α in each sampling step is adjusted by multiplying a step size parameter μ. Specifically, the stabilization coefficient α is calculated in accordance with the following formulas.

$$\alpha_{n+1}=\alpha_n-\mu\frac{\partial J_n}{\partial \alpha_n},\ \frac{\partial J_n}{\partial \alpha_n}=2e_n'\hat{y}_n \Rightarrow \alpha_{n+1}=\alpha_n-2\mu e_n'\hat{y}_n$$

where n+1 represents the next sampling time, and μ represents the step size parameter. In the above formulas, −2μe'y^ is the amount of update of the stabilization coefficient α.

Further, to improve the stability, the stabilization coefficient α is set to a value greater than or equal to zero, as shown by the following conditional statement.

If $\alpha_n<0$, Then $\alpha_n=0$

In a case where noise amplification or abnormal sound occurs, the noise and the control sound do not cancel each other well, whereby the component of the reaching control sound y contained in the error signal e increases considerably. The corrected error signal e' also increases considerably in a similar manner. Therefore, in order to stabilize the canceling error, the active vibratory noise controller 13 of the present embodiment is provided with the stability improving unit 50 configured to correct the error signal e. The stability improving unit 50 adaptively updates the stabilization coefficient α in an increasing direction such that the corrected error signal e' is reduced, and hence, the reaching control sound y is suppressed. As a result of the suppression of the reaching control sound y, the amplification of the sound pressure at the error microphone 11 is alleviated. From the above explanation, the effect of the active vibratory noise controller 13 can be understood qualitatively.

Figure 6:
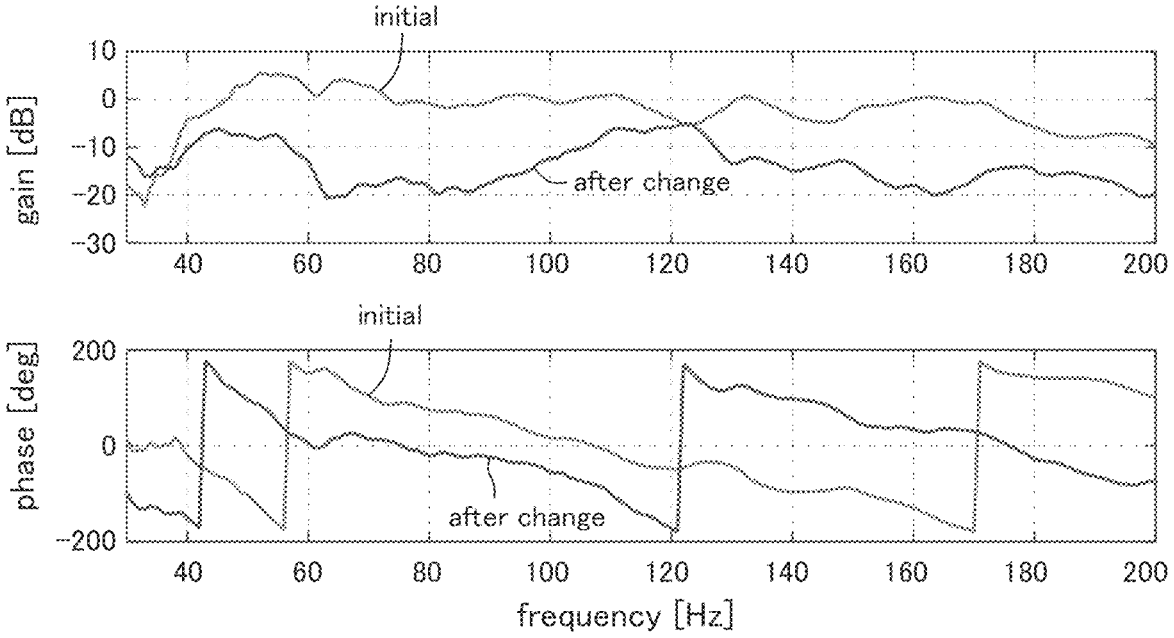
FIG. 6 is a graph showing an assumed change in the acoustic characteristics.

Next, operations and effects confirmed with the active vibratory noise reduction system 10 regarding the embodiment will be described. FIG. 6 is a graph showing an assumed change in the acoustic characteristics C of the active vibratory noise reduction system 10 shown in FIG. 1. As shown in FIG. 6, it is assumed that in the frequency band (100 Hz to 150 Hz) corresponding to the engine rotational speed from 3000 to 4500 rpm, the acoustic characteristics C have changed from initial characteristics shown by thin lines to current characteristics shown by thick lines, and a difference has been created between the simulated transfer characteristics C^, which are a control parameter, and the current actual acoustic characteristics C.

Figure 7:
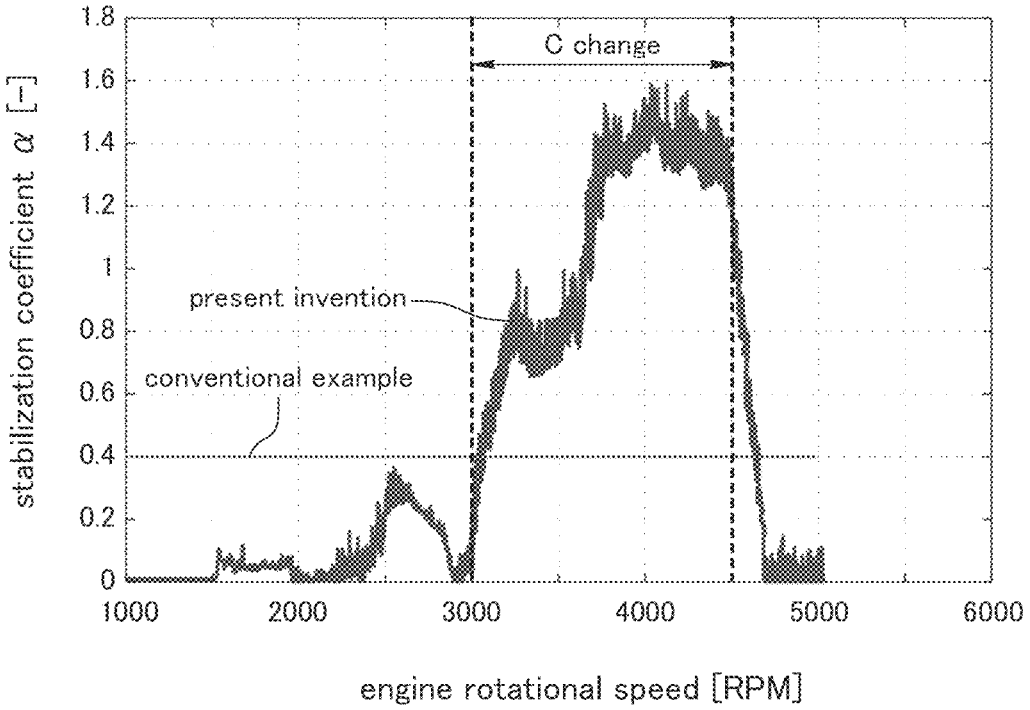
FIG. 7 is a graph showing a stabilization coefficient generated by the active vibratory noise reduction system when there is a change in the acoustic characteristics.

When the active vibratory noise controller 13 of the embodiment executes the noise reduction control under such conditions, the stabilization coefficient α is updated as indicated by "present invention" in FIG. 7. Note that in the conventional example shown by thin lines in FIG. 7, the stabilization coefficient α is fixedly set to 0.4. As shown in FIG. 7, in the active vibratory noise reduction system 10 according to the embodiment, only when the difference between the actual acoustic characteristics C and the simulated transfer characteristics C^ is large, the stabilization coefficient α is adaptively updated to be larger.

Figure 8:
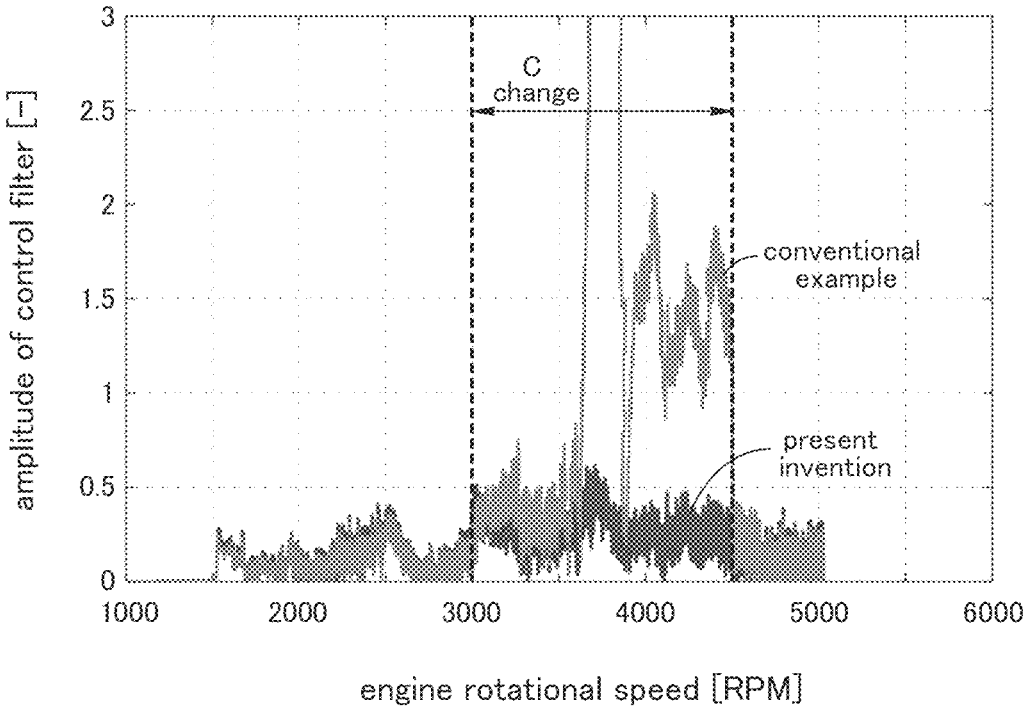
FIG. 8 is a graph showing the amplitude of the adaptive notch filter in the active vibratory noise reduction system when there is a change in the acoustic characteristics in comparison with a conventional example.

As a result, the amplitude of the first adaptive filter 41 and the second adaptive filter 42 of the adaptive notch filter 26 serving as a control filter (where the amplitude corresponds to the output of the control sound) becomes as shown in FIG. 8. As shown in FIG. 8, in the active vibratory noise reduction system 10 according to the embodiment, the amplitude of the adaptive notch filter 26 is suppressed compared to the conventional example in which the stabilization coefficient α is fixed to a constant value of 0.4.

Figure 9:
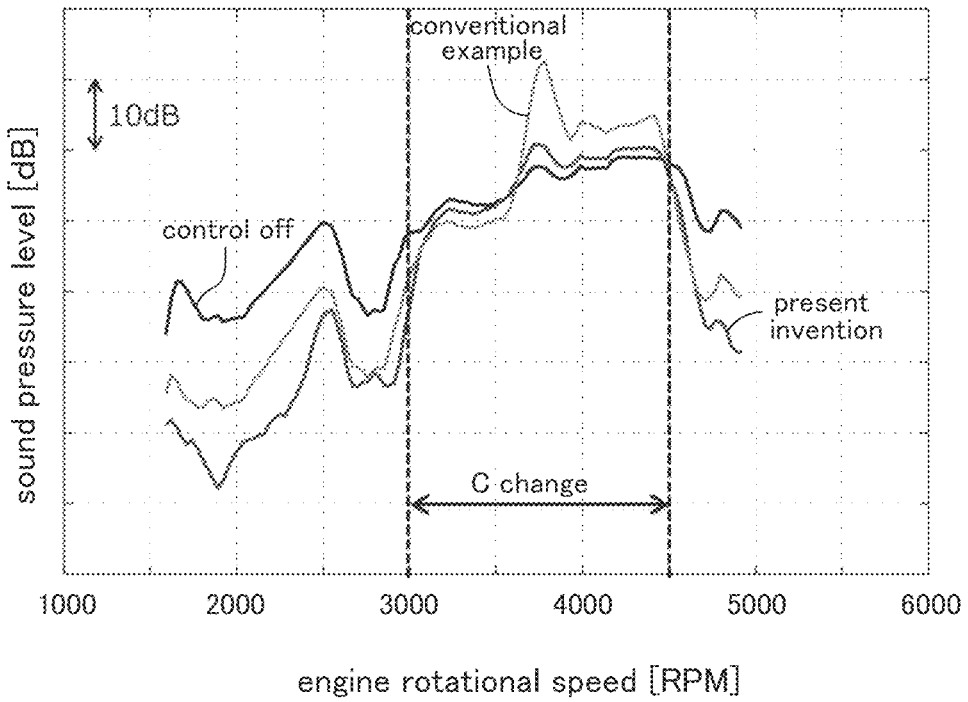
FIG. 9 is a graph showing the sound pressure level observed in the active vibratory noise reduction system when there is a change in the acoustic characteristics in comparison with a case without control and with a conventional example.

As a result, as shown in FIG. 9, in an engine rotational speed range lower than or equal to 3000 rpm, the sound pressure level in the present invention (the active vibratory noise reduction system 10 according to the embodiment) shown by thick lines is lower than the sound pressure level in the conventional example shown by thin lines by 5 to 10 dB (namely, the noise canceling performance is higher in the present invention). In an engine rotational speed range from 3000 to 4500 rpm in which the actual acoustic characteristics C change, noise amplification is suppressed. Particularly, in the engine rotational speed range near 3600 rpm, noise amplification is reduced considerably compared to the conventional example. Further, in an engine rotational speed range higher than or equal to 4500 rpm in which there is no change in the actual acoustic characteristics C, the noise canceling performance is restored.

Figure 10:
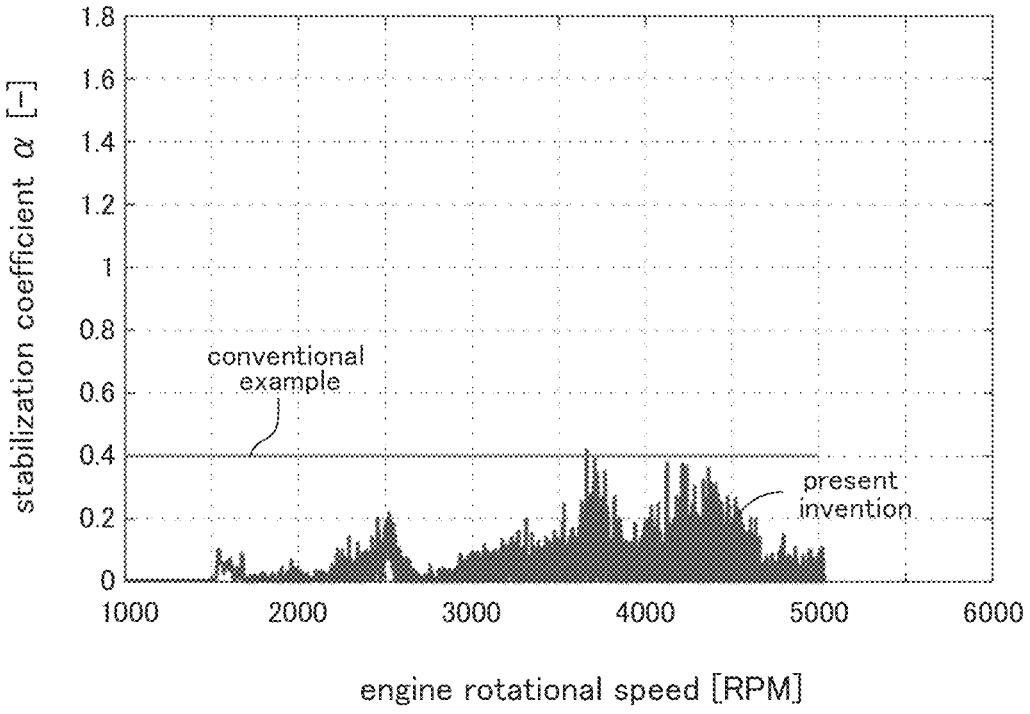
FIG. 10 is correlation diagram between the engine rotational speed and the stabilization coefficient when there is no change in the acoustic characteristics.

In a case where there is no change occurring in the acoustic characteristics C and hence there is no difference between the simulated transfer characteristics C^ (control parameter) and the actual acoustic characteristics C, the stabilization coefficient α becomes as shown in FIG. 10. As shown in FIG. 10, when there is no difference between the actual acoustic characteristics C and the simulated transfer characteristics C^, the stabilization coefficient α is always kept small in the active vibratory noise reduction system 10 according to the embodiment.

Figure 11:
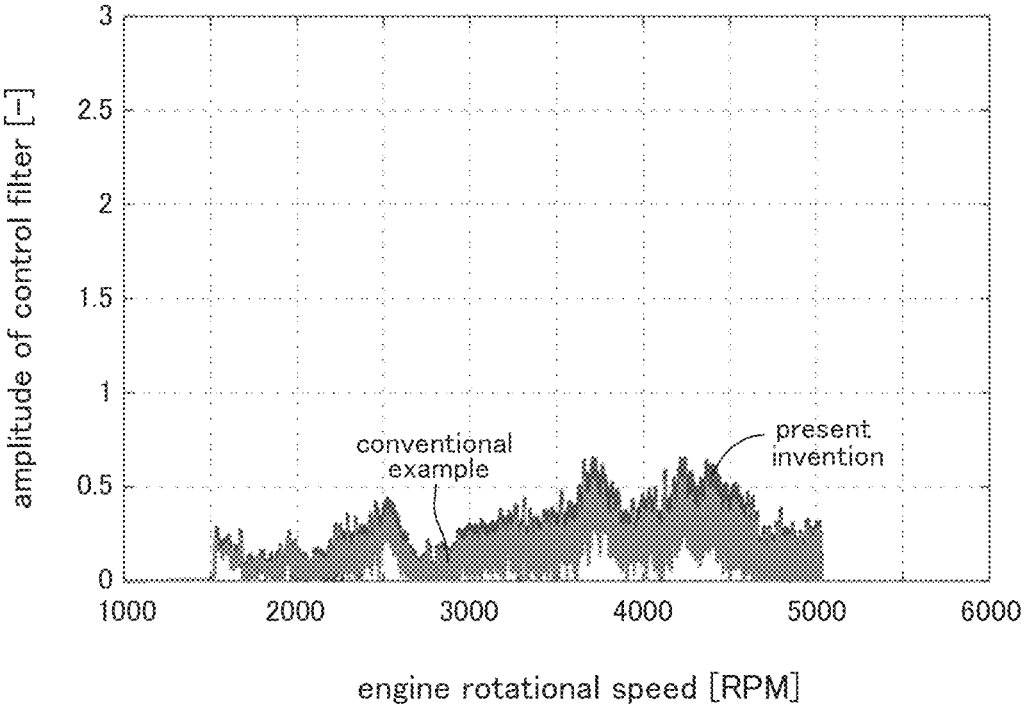
FIG. 11 is a correlation diagram between the engine rotational speed and the amplitude of the adaptive notch filter when there is no change in the acoustic characteristics.

The amplitude of the adaptive notch filter 26 at this time is shown in FIG. 11. As appreciated from FIG. 11, there is not a large difference in the amplitude of the adaptive notch filter 26 between the active vibratory noise reduction system 10 according to the embodiment and the conventional example.

Figure 12:
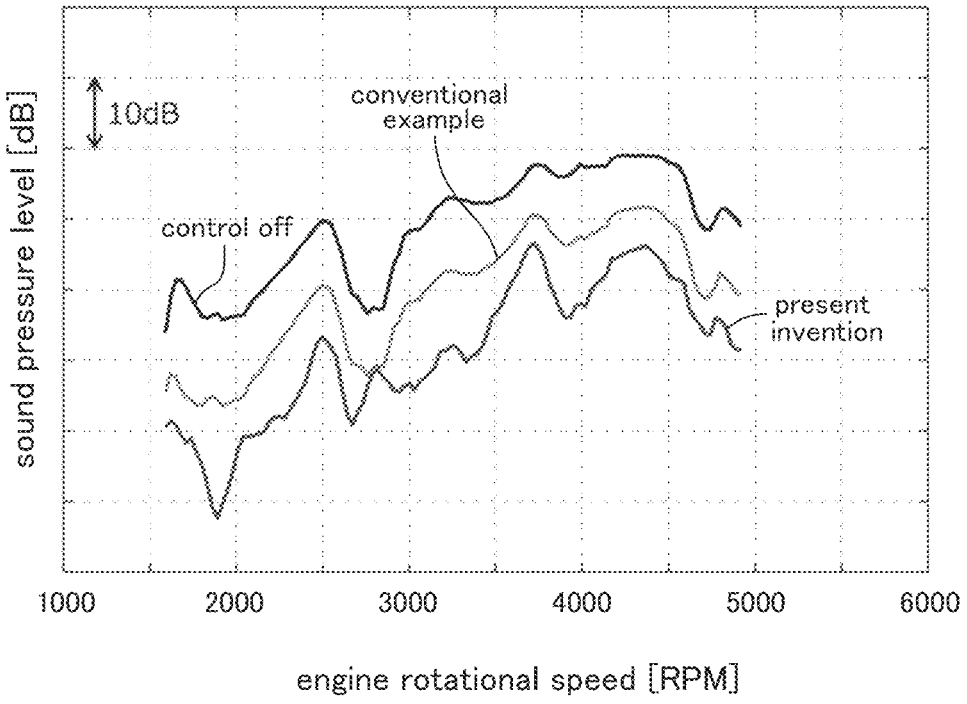
FIG. 12 is a correlation diagram between the engine rotational speed and the sound pressure level when there is no change in the acoustic characteristics.

On the other hand, as shown in FIG. 12, the active vibratory noise reduction system 10 according to the embodiment achieves the sound pressure level lower than that of the conventional example by about 5 to 10 dB (namely, high noise canceling performance) over the entire control band. From the foregoing results, the superiority of the active vibratory noise reduction system 10 according to the embodiment can be confirmed.

As described above, the stability improving unit 50 includes, in addition to the corrective filter 55 and the fourth adder 46, the stabilization coefficient updating unit 56 configured to sequentially update the stabilization coefficient α by using the adaptive algorithm based on the corrected error signal e' and the reaching control sound estimation value y^. Therefore, the stabilization coefficient α is adaptively adjusted during the control and the stabilization coefficient α is made large only when necessary, whereby both reliable control stability and excellent noise canceling performance can be achieved.

Second Embodiment

Next, with reference to FIGS. 13 to 18, a second embodiment of the present invention will be described. Note that the elements same as or similar to those of the first embodiment are denoted by same reference signs and redundant description may not be repeated. The active vibratory noise reduction system 10 of the second embodiment differs from the first embodiment with respect to the configuration of the stability improving unit 50 so that two virtual values of the error signal e are generated. In the following, description will be made concretely.

Similarly to the first embodiment, the fourth adder 46 adds the error signal correction value $\alpha\hat{y}$ supplied from the corrective filter 55 to the error signal e supplied from the A/D converter 45 thereby to generate the corrected error signal e'. The corrected error signal e' generated at the fourth adder 46 is supplied to the stabilization coefficient updating unit 56 and is used in the update of the stabilization coefficient $\alpha$ necessary for the generation of the error signal correction value $\alpha\hat{y}$. Specifically, the stabilization coefficient updating unit 56 updates the stabilization coefficient $\alpha$ in accordance with the following formulas in the same manner as in the first embodiment.

$$\alpha_{n+1}=\alpha_n-2\mu e'_n\hat{y}_n,\ e'_n=e_n+\alpha_n\hat{y}_n$$

In addition to the above-described configuration, the stability improving unit 50 is provided with a correction value adjustment unit 61.

Figure 13:
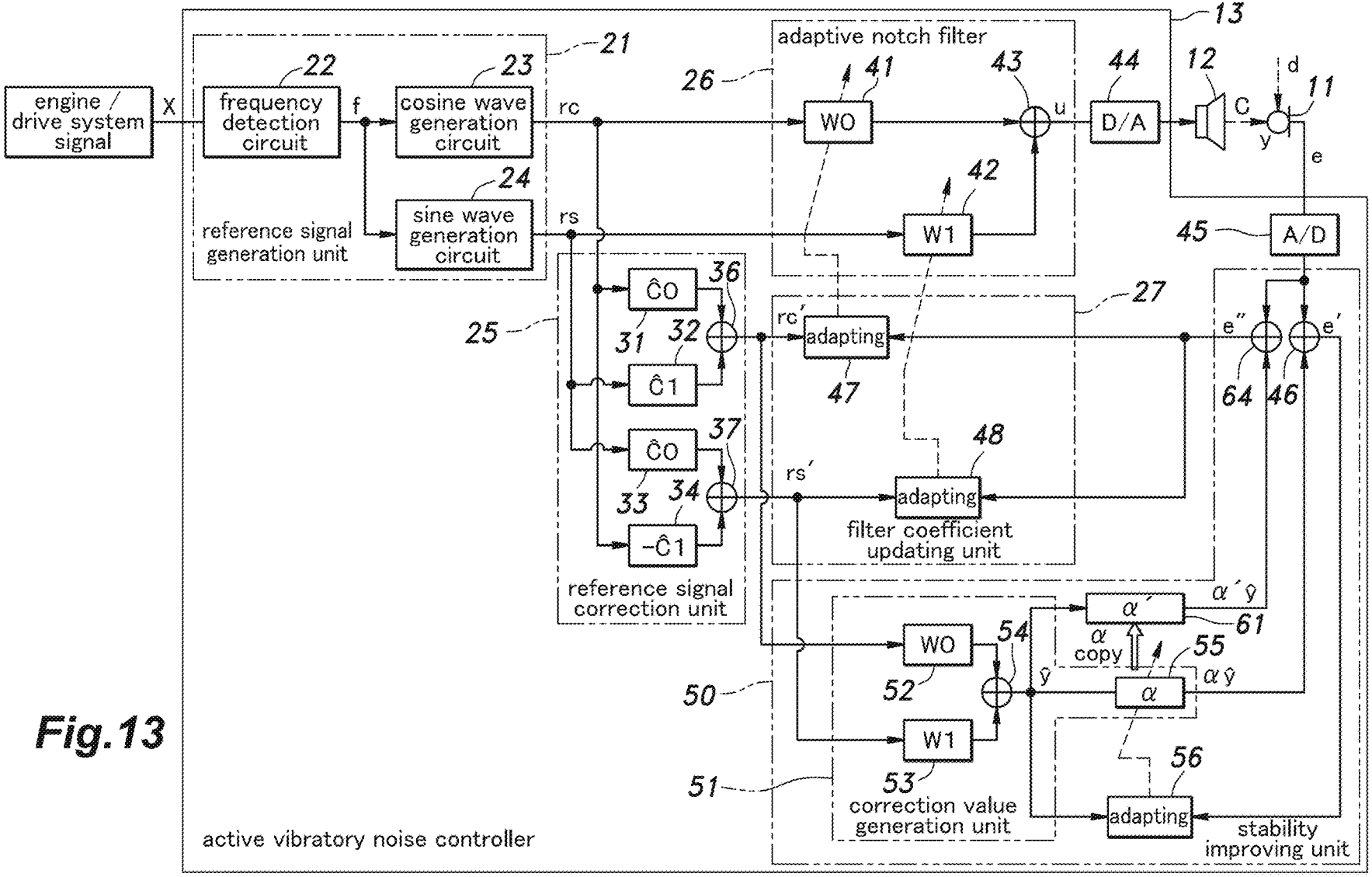
FIG. 13 is a functional block diagram of the active vibratory noise reduction system according to the second embodiment.
Figure 14:
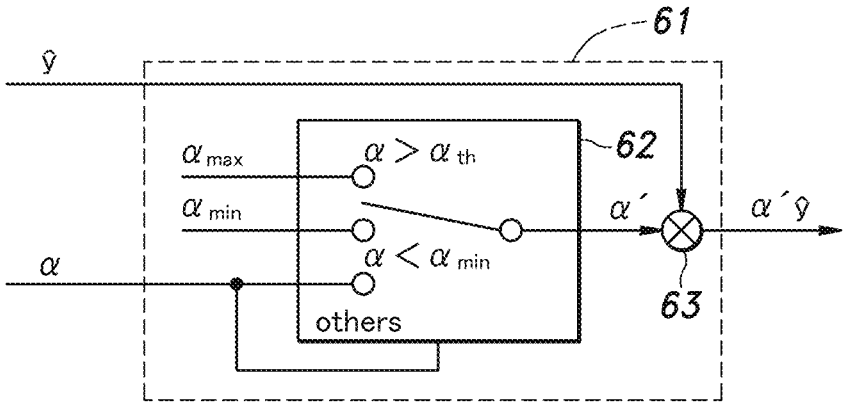
FIG. 14 is a block diagram of a correction value adjustment unit shown in FIG. 13.

FIG. 14 is a block diagram of the correction value adjustment unit 61 shown in FIG. 13. As shown in FIG. 14, the correction value adjustment unit 61 includes an $\alpha'$ decision circuit 62 and a multiplier 63. The $\alpha'$ decision circuit 62 is configured to receive the value of the stabilization coefficient $\alpha$ (more specifically, copy of the value) which is adaptively adjusted at the corrective filter 55. The $\alpha'$ decision circuit 62 has multiple (three, for example) modes with varying degrees of adjustment of the stabilization coefficient $\alpha$, and based on the received stabilization coefficient $\alpha$, selects one of the multiple modes and decides an adjusted stabilization coefficient $\alpha'$ in accordance with the selected mode, so that the adjusted stabilization coefficient $\alpha'$ is used in the update of the filter coefficients W of the adaptive notch filter 26. In the illustrated embodiment, the multiple modes include a stability securing mode, a control output limiting mode, and an adaptive mode, which are selected in accordance with the stabilization coefficient $\alpha$ to automatically set the adjusted stabilization coefficient $\alpha'$ in three steps (specifically, to one of a prescribed maximum value $\alpha_{max}$ that is pre-set, a prescribed minimum value $\alpha_{min}$ that is pre-set, and the stabilization coefficient $\alpha$ as it is) in accordance with the following conditional statements (1)-(3).

$$\text{If } \alpha_n>\alpha_{th}, \text{ Then } \alpha'_n=\alpha_{max} \quad (1)$$

$$\text{Else if } \alpha_n<\alpha_{min}, \text{ Then } \alpha'_n=\alpha_{min} \quad (2)$$

$$\text{Else, Then } \alpha'_n=\alpha_n \quad (3)$$

where $\alpha_{th}$ represents a prescribed threshold value.

Specifically, as indicated by statement (1), when the stabilization coefficient $\alpha$ is greater than the prescribed threshold value $\alpha_{th}$ (for example, 0.8), the $\alpha'$ decision circuit 62 selects the stability securing mode and sets the maximum value $\alpha_{max}$ (for example, 5.0), which is greater than the threshold value $\alpha_{th}$, as the adjusted stabilization coefficient $\alpha'$. Note that the threshold value $\alpha_{th}$ is set to a relatively large value as a determination reference indicating a situation in which the control may become unstable. When the stabilization coefficient $\alpha$ becomes greater than the threshold value $\alpha_{th}$, the $\alpha'$ decision circuit 62 determines that there is a high possibility that the noise amplification and/or the abnormal sound may occur, and switches the adjusted stabilization coefficient $\alpha'$ to the maximum value $\alpha_{max}$ (the stability securing mode), aiming to reliably secure the stability and suppress the noise amplification.

As indicated by statement (2), when the stabilization coefficient $\alpha$ is smaller than the prescribed minimum value $\alpha_{min}$ (for example, 0.55), the $\alpha'$ decision circuit 62 selects the control output limiting mode and sets the minimum value $\alpha_{min}$ as the adjusted stabilization coefficient $\alpha'$ so that the adjusted stabilization coefficient $\alpha'$ does not become too small. The minimum value $\alpha_{min}$ is a minimum value that can be set as the adjusted stabilization coefficient $\alpha'$ and is set to a relatively small value greater than or equal to 0 (zero). One aim of setting the minimum value $\alpha_{min}$ is to ensure minimum system stability. Another aim of setting the minimum value $\alpha_{min}$ is to ensure that adequate noise cancellation is performed near an ear of a vehicle occupant.

Figure 15:
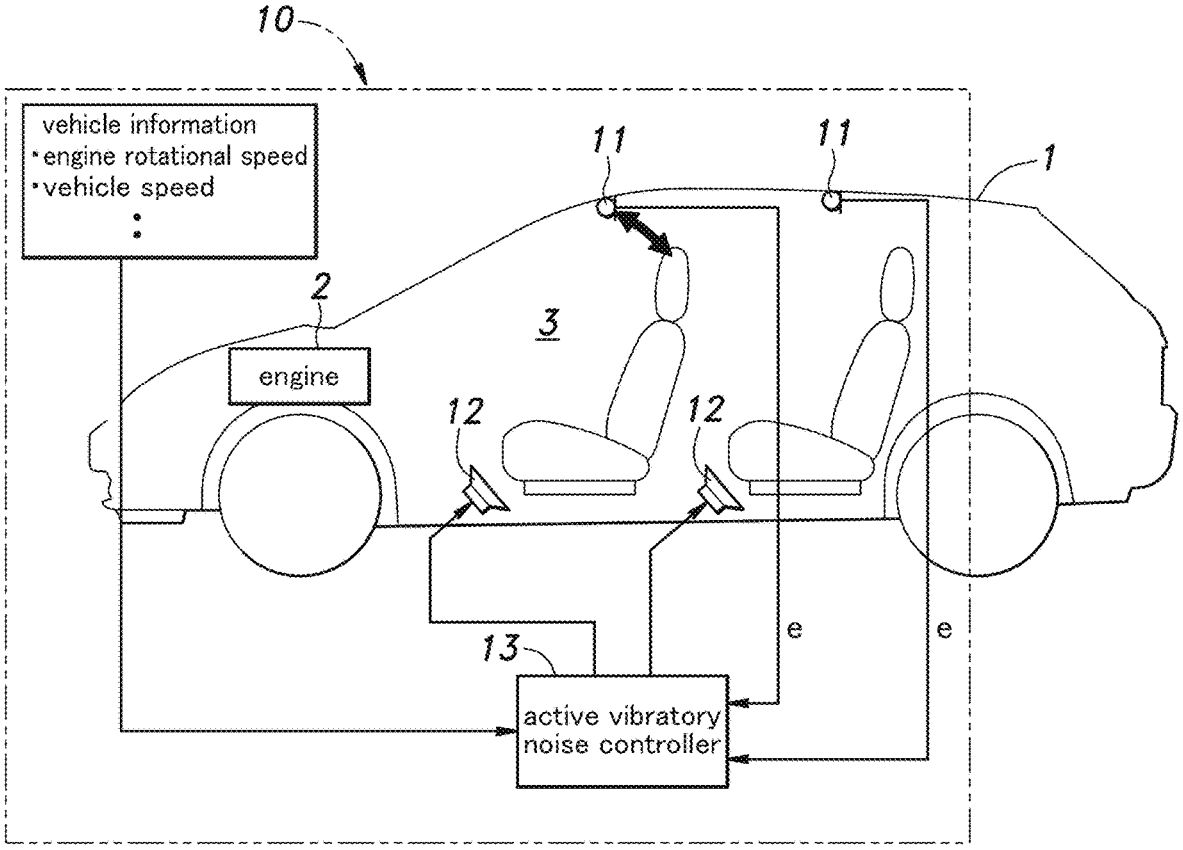
FIG. 15 is a configuration diagram showing an application example of the active vibratory noise reduction system shown in FIG. 13.

As shown in FIG. 15, in a case where the in-compartment noise is to be reduced, the error microphone 11 is often installed in the roof lining, and the sound pressure at the position of the error microphone 11 tends to be higher than the sound pressure near an ear of a vehicle occupant where the noise should be canceled. In such a case, large control sound may be output to cancel the noise at the installation position of the error microphone 11 and this may result in an amplification of the sound pressure near the ear of the vehicle occupant by the excessive control sound. To avoid such a situation, the minimum value $\alpha_{min}$ is provided to limit the amplitude of the control sound so that adequate noise cancellation is performed near the ear of the vehicle occupant.

As indicated by statement (3), in the other cases (when the stabilization coefficient $\alpha$ is smaller than or equal to the prescribed threshold value $\alpha_{th}$ and greater than or equal to the prescribed minimum value $\alpha_{min}$), the $\alpha'$ decision circuit 62 selects the adaptive mode and sets the stabilization coefficient $\alpha$ as the adjusted stabilization coefficient $\alpha'$ without modification.

Figure 16:
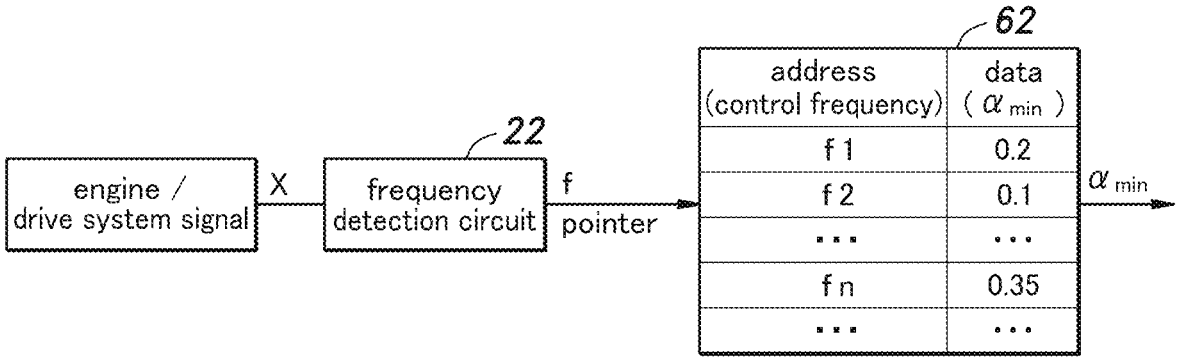
FIG. 16 is a block diagram showing a table of the minimum value $\alpha_{min}$ of an adjusted stabilization coefficient.

It is to be noted here that the magnitude relationship between the sound pressure at the error microphone 11 and the sound pressure near the ear of the vehicle occupant varies depending on the vibration frequency of the engine/drive system, which is the vibratory noise source. Therefore, the minimum value $\alpha_n$ of the adjusted stabilization coefficient $\alpha'$ is preferably set depending on the vibration frequency of the vibratory noise source. To achieve this, the $\alpha'$ decision circuit 62 uses a table storing the frequencies f of the vibratory noise detected by the frequency detection circuit 22 in the address column and the respective values of the minimum value $\alpha_n$ in the data column. FIG. 16 is a block diagram exemplarily showing the table of the minimum value $\alpha_{min}$ of the adjusted stabilization coefficient $\alpha'$. Using the frequency f of the vibratory noise obtained by the frequency detection circuit 22 (FIG. 13) as a pointer, the $\alpha'$ decision circuit 62 reads out a value of the minimum value $\alpha_{min}$ from the table.

Also, in order to prevent hearing discomfort that may be caused when the stable and non-stable modes are switched repeatedly in a short period of time, when the adjusted stabilization coefficient $\alpha'$ is set to $\alpha_{max}$, the $\alpha'$ decision circuit 62 holds the value of the adjusted stabilization coefficient $\alpha'$ at $\alpha_{max}$ (in other words, holds the stability securing mode) over a prescribed time period t. This holding is performed as indicated by the following statements.

When $t=0$, $cnt_0=0$

If $\alpha_n>\alpha_{th}$, Then $cnt_n=tFs$

Else, Then $cnt_{n+1}=cnt_n-1$, $cnt_n\geq 0$ where cnt represents a counter value, and Fs represents a sampling frequency. When the counter value cnt=0, the aforementioned conditional statements (2), (3) are executed.

As shown in FIG. 14, the multiplier 63 multiplies the reaching control sound estimation value y^ supplied from the fifth adder 54 by the adjusted stabilization coefficient α' decided by the α' decision circuit 62 to generate an adjusted correction value α'y^.

As shown in FIG. 13, the adjusted correction value α'y^ generated by the correction value adjustment unit 61 is supplied to a sixth adder 64 and is added to the error signal e to correct the same. Namely, the sixth adder 64 functions as an error signal adjustment unit configured to correct the error signal e by using the adjusted correction value α'y^ thereby to generate an adjusted error signal e". The adjusted error signal e" is calculated in accordance with the following formula by using the adjusted stabilization coefficient α' which is set in steps.

$$e''_n=e_n+\alpha'_n\hat{y}_n.$$

Thereby, the apparent adjusted error signal e" is output from the sixth adder 64. The adjusted error signal e" is supplied to the first filter coefficient updating unit 47 and the second filter coefficient updating unit 48 and are used in the update of the first adaptive filter 41 and the second adaptive filter 42 of the adaptive notch filter 26.

Specifically, the first filter coefficient updating unit 47 calculates the first filter coefficient W0 of the first adaptive filter 41 of the adaptive notch filter 26 by using the LMS algorithm based on the corrected cosine wave signal rc' supplied from the reference signal correction unit 25 and the adjusted error signal e" supplied from the sixth adder 64 such that the adjusted error signal e" is minimized. The second filter coefficient updating unit 48 calculates the second filter coefficient W1 of the second adaptive filter 42 of the adaptive notch filter 26 by using the LMS algorithm based on the corrected sine wave signal rs' supplied from the reference signal correction unit 25 and the adjusted error signal e" supplied from the sixth adder 64 such that the adjusted error signal e" is minimized.

Thereby, the cosine wave signal rc and the sine wave signal rs filtered by the first adaptive filter 41 and the second adaptive filter 42 of the adaptive notch filter 26 are optimized, and the periodic noise d from the engine 2/the drive system is canceled by the control sound generated by the loudspeaker 12 based on the control signal u, whereby the in-compartment noise is reduced.

Next, operations and effects confirmed with the active vibratory noise controller 13 of this embodiment will be described. Similarly to the first embodiment, it is assumed that the change in the acoustic characteristics C shown in FIG. 6 has occurred in the frequency band (100 Hz to 150 Hz) corresponding to the engine rotational speed from 3000 to 4500 rpm.

Figure 17:
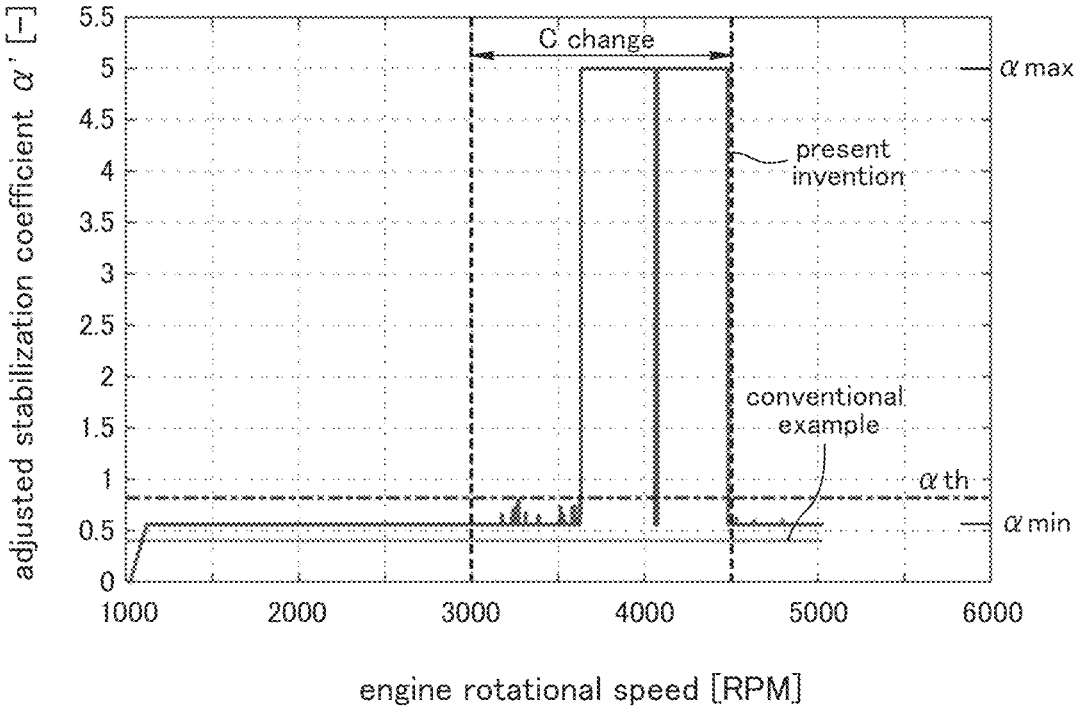
FIG. 17 is a correlation diagram between the engine rotational speed and the adjusted stabilization coefficient.

When the active vibratory noise controller 13 of the embodiment executes the noise reduction control under such conditions, the stabilization coefficient α is updated as indicated by "present invention" in FIG. 7. In the active vibratory noise reduction system 10 according to the embodiment, when the difference between the actual acoustic characteristics C and the simulated transfer characteristics C^ is large, the adapted stabilization coefficient α exceeds the threshold value $\alpha_{th}$ and the adjusted stabilization coefficient α' is adaptively set to the maximum value $\alpha_{max}$, as shown in FIG. 17. When the stabilization coefficient α is smaller than the minimum value $\alpha_{min}$, the adjusted stabilization coefficient α' is adaptively set to the minimum value $\alpha_{min}$ so that the adjusted stabilization coefficient α' does not become too small. In the other cases, the value of the stabilization coefficient α as it is set as the adjusted stabilization coefficient α'.

Figure 18:
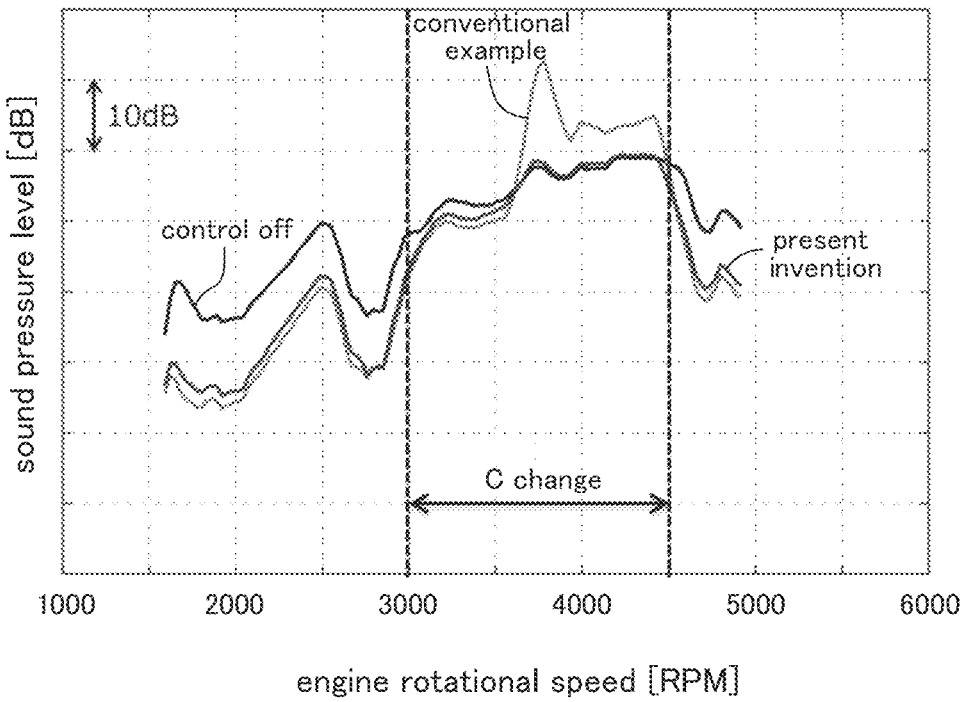
FIG. 18 is a correlation diagram between the engine rotational speed and the sound pressure level.
Figure 19:
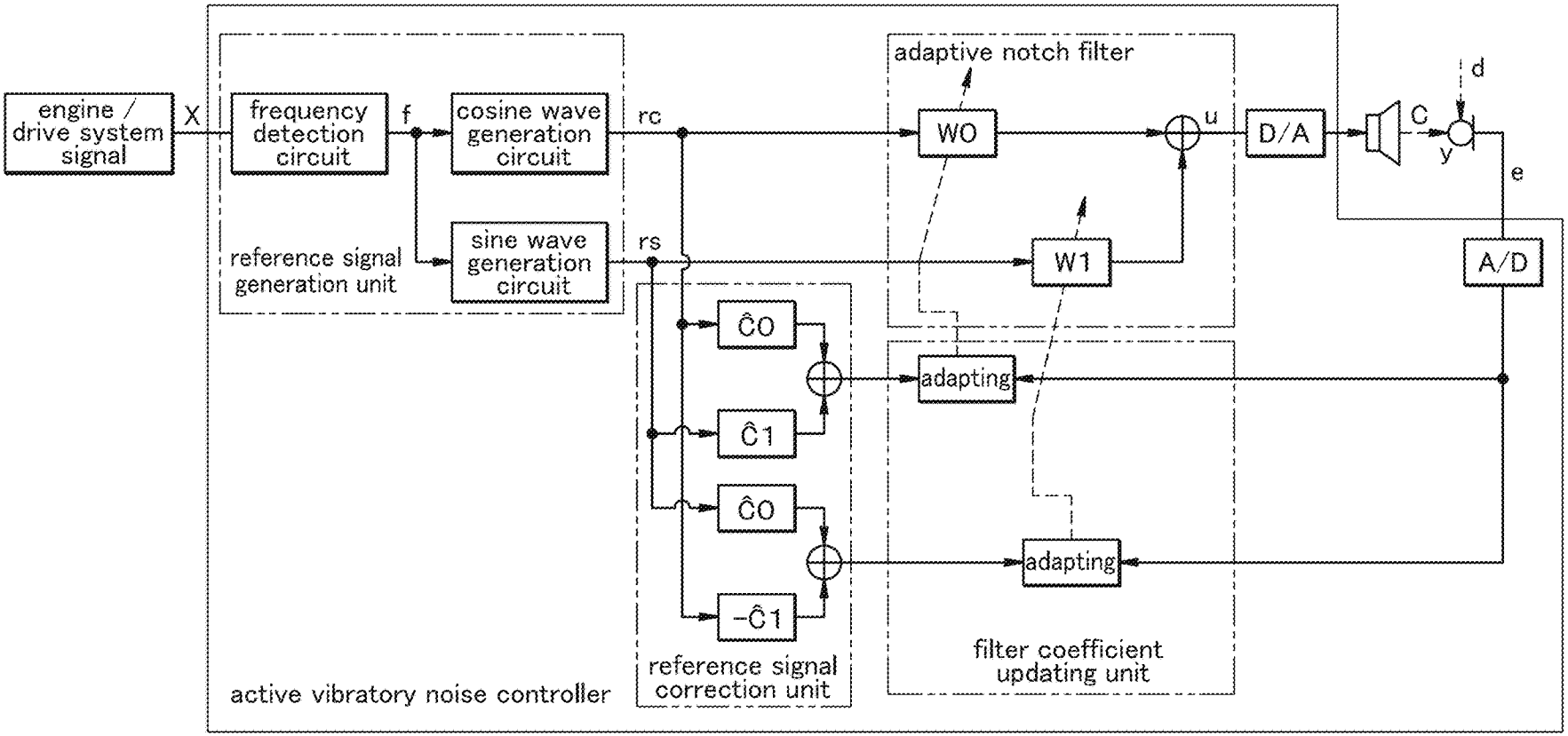
Fig.19 PRIOR ART
FIG. 19 is a functional block diagram of a conventional active vibratory noise reduction system.
Figure 20:
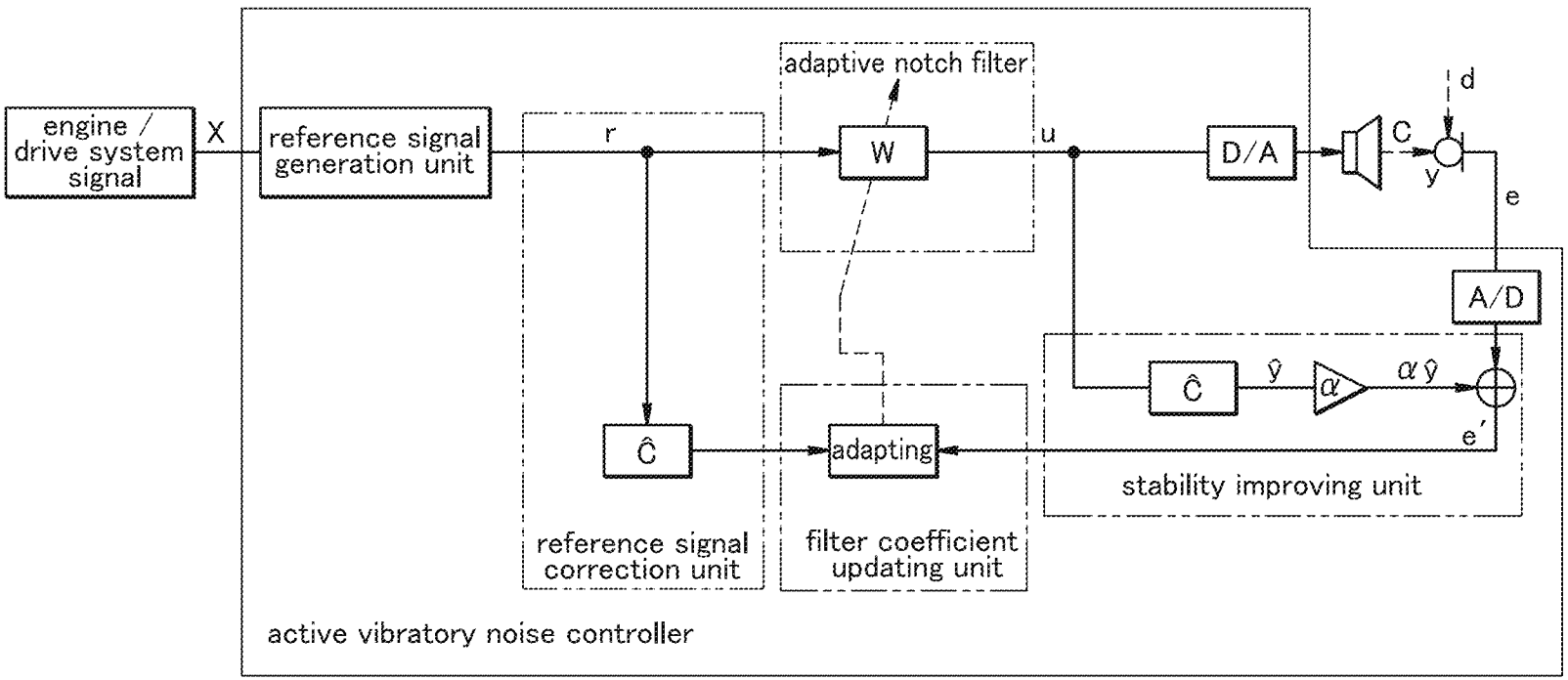
Fig.20 PRIOR ART
FIG. 20 is a functional block diagram of another conventional active vibratory noise reduction system.

As a result, as shown in FIG. 18, at engine rotational speeds lower than or equal to 3000 rpm, the noise level at the position of the error microphone 11 is suppressed in the present invention indicated by thick lines, as in the conventional example indicated by thin lines. In the engine rotational speed range from 3000 to 4500 rpm in which the acoustic characteristics C change, noise amplification is further suppressed in the present embodiment compared to the conventional example and the first embodiment (FIG. 7). Also, in the present embodiment, in the engine rotational speed range higher than or equal to 4500 rpm in which there is no change in the acoustic characteristics C, the noise canceling performance is restored.

As described above, in the present embodiment, the correction value adjustment unit 61 has multiple modes with varying degrees of adjustment of the stabilization coefficient α, and obtains the adjusted stabilization coefficient α' by adjusting the stabilization coefficient α in accordance with the degree of adjustment of the mode selected based on the stabilization coefficient α. Further, the reaching control sound estimation value y^ is multiplied by the adjusted stabilization coefficient α' so that the error signal correction value αy^ is adjusted to the adjusted correction value α'y^. Then, the sixth adder 64 uses the adjusted correction value α'y^ to correct the error signal e to be supplied to the first filter coefficient updating unit 47 and the second filter coefficient updating unit 48. Thus, besides the adaptive processing of the stabilization coefficient α, the adjusted stabilization coefficient α' used in the update of the filter coefficients W (W0, W1) of the adaptive notch filter 26 can be set in steps in accordance with the mode.

Specifically, the correction value adjustment unit 61 has the control output limiting mode which is selected when the stabilization coefficient α is smaller than the minimum value $\alpha_{min}$ and in which the minimum value $\alpha_{min}$ is set as the adjusted stabilization coefficient α', the stability securing mode which is selected when the stabilization coefficient α is greater than the threshold value $\alpha_{th}$ and in which the maximum value $\alpha_{max}$ is set as the adjusted stabilization coefficient α', and the adaptive mode which is selected when the stabilization coefficient α is greater than or equal to the minimum value $\alpha_{min}$ and smaller than or equal to the threshold value $\alpha_{th}$ and in which the stabilization coefficient α as it is set as the adjusted stabilization coefficient α'. Thus, the adjusted stabilization coefficient α' used in the update of the filter coefficients W (W0, W1) of the adaptive notch filter 26 is set in steps in accordance with the mode selected based on the value of the stabilization coefficient α, whereby the stability can be improved even further while the noise canceling effect near the ear of the vehicle occupant can be ensured.

Further, as described with reference to FIG. 16, the correction value adjustment unit 61 sets the minimum value $\alpha_{min}$ of the stabilization coefficient α depending on the frequency f of the vibratory noise. Thereby, the difference between the sound pressure at the error microphone 11 and the actual sound pressure near the ear of the vehicle occupant can be reduced in accordance with the vibration frequency of the vibratory noise source.

Concrete embodiments of the present invention have been described in the foregoing, but the present invention should not be limited by the foregoing embodiments and various modifications and alterations are possible within the scope of the present invention. For example, in the foregoing embodiments, description was made of an example in which the active vibratory noise reduction system 10 has a configuration shown in FIG. 1, but the active vibratory noise reduction system 10 may have a configuration shown in FIG. 2 or FIG. 3. Besides this, the concrete structure, arrangement, number, etc. of the components as well as the formulas, procedures, etc. may be appropriately changed within the scope of the present invention. Further, the above-described embodiments may be combined as appropriate. Also, not all of the structural elements shown in the above embodiments are necessarily indispensable and they may be selectively adopted as appropriate.

The invention claimed is:

1. An active vibratory noise reduction system, comprising:

a canceling vibratory sound generator configured to generate canceling vibratory sound for canceling vibratory noise generated from a vibratory noise source;

an error signal detector configured to detect a canceling error between the vibratory noise and the canceling vibratory sound as an error signal; and an active vibratory noise controller configured to receive the error signal and to supply a control signal for causing the canceling vibratory sound generator to generate the canceling vibratory sound, wherein the active vibratory noise controller comprises:

a reference signal generation unit configured to generate a reference signal that is synchronous with a vibration frequency of the vibratory noise source;

a reference signal correction unit configured to correct the reference signal with simulated transfer characteristics to generate a corrected reference signal, the simulated transfer characteristics representing acoustic characteristics from the canceling vibratory sound generator to the error signal detector that are identified beforehand;

an adaptive notch filter configured to generate the control signal based on the reference signal;

a filter coefficient updating unit configured to sequentially update filter coefficients of the adaptive notch filter by using an adaptive algorithm; and a stability improving unit configured to correct the error signal, wherein the stability improving unit comprises:

a correction value generation unit configured to generate, based on the corrected reference signal, a reaching control sound estimation value, which is an estimated value of the canceling vibratory sound that reaches the error signal detector, and to multiply the reaching control sound estimation value by a stabilization coefficient to generate an error signal correction value; and an error signal correction unit configured to correct the error signal by using the error signal correction value to generate a corrected error signal, wherein the filter coefficient updating unit sequentially updates the filter coefficients based on the corrected reference signal and the corrected error signal, and wherein the stability improving unit further comprises a stabilization coefficient updating unit configured to sequentially update the stabilization coefficient based on the corrected error signal and the reaching control sound estimation value by using an adaptive algorithm.

2. The active vibratory noise reduction system according to claim 1, wherein the stability improving unit further comprises:

a correction value adjustment unit having multiple modes with varying degrees of adjustment of the stabilization coefficient, the correction value adjustment unit being configured to obtain an adjusted stabilization coefficient by adjusting the stabilization coefficient in accordance with the degree of adjustment of one of the multiple modes selected based on the stabilization coefficient and to generate an adjusted correction value by multiplying the reaching control sound estimation value by the adjusted stabilization coefficient; and an error signal adjustment unit configured to generate an adjusted error signal by correcting the error signal by using the adjusted correction value generated by the correction value adjustment unit, and wherein the filter coefficient updating unit sequentially updates the filter coefficients based on the corrected reference signal and the adjusted error signal.

3. The active vibratory noise reduction system according to claim 2, wherein the multiple modes includes a control output limiting mode which is selected when the stabilization coefficient is smaller than a prescribed minimum value and in which the minimum value is set as the adjusted stabilization coefficient, a stability securing mode which is selected when the stabilization coefficient is greater than a prescribed threshold value greater than the minimum value and in which a prescribed maximum value greater than the threshold value is set as the adjusted stabilization coefficient, and an adaptive mode which is selected when the stabilization coefficient is greater than or equal to the minimum value and smaller than or equal to the threshold value and in which the stabilization coefficient is set as the adjusted stabilization coefficient.

4. The active vibratory noise reduction system according to claim 3, wherein the correction value adjustment unit is configured to set the minimum value depending on the vibration frequency of the vibratory noise source.

5. The active vibratory noise reduction system according to claim 3, wherein when the stabilization coefficient exceeds the maximum value, the correction value adjustment unit holds the adjusted stabilization coefficient at the maximum value for a prescribed time period.

6. The active vibratory noise reduction system according to claim 4, wherein when the stabilization coefficient exceeds the maximum value, the correction value adjustment unit holds the adjusted stabilization coefficient at the maximum value for a prescribed time period.

* * * * *